US007114722B2

(12) United States Patent
Short

(10) Patent No.: US 7,114,722 B2
(45) Date of Patent: Oct. 3, 2006

(54) PLASTIC KUBB (COOB) GAME & CARRYING CASE

(76) Inventor: Christopher Jon Short, 1 Wayne Cir., Lower Gwynedd, PA (US) 19002

( * ) Notice: Subject to any disclaimer, the term of this patent is extended or adjusted under 35 U.S.C. 154(b) by 0 days.

(21) Appl. No.: 11/056,217

(22) Filed: Feb. 11, 2005

(65) Prior Publication Data

US 2006/0181023 A1 Aug. 17, 2006

(51) Int. Cl.
*A63F 3/00* (2006.01)

(52) U.S. Cl. ..... 273/255; 273/288

(58) Field of Classification Search ..... 273/276, 273/288, 290, 255; 206/579
See application file for complete search history.

(56) References Cited

U.S. PATENT DOCUMENTS 688,900 A * 12/1901 Toepfer ..... 273/283
3,517,935 A * 6/1970 Lanier ..... 273/290
3,984,110 A * 10/1976 Eckert ..... 273/286
4,381,113 A * 4/1983 Simons ..... 273/286

* cited by examiner

*Primary Examiner*—Vishu Mendiratta

(57) ABSTRACT

Apparatus that interconnects the twenty-one pieces used to play the ancient backyard target-throwing game "kubb", pronounced "coob", into a portable self-contained carrying case that looks like a briefcase. An improvement over transporting kubb in heavy crates, boxes, or bags. To assemble: five throwing dowels fit horizontally through five evenly spaced holes drilled through a large vertically standing block with carved crown top called the "king". Each exposed dowel-half jetting right and left from each king hole receives a smaller block or "kubb", each containing a matching drilled hole. Ten kubbs completely cover dowel halves and slide up snug against king. Cord attached to the king and looped at both ends receives a sixth dowel, creating a handle. Four playing-field boundary pegs drop into matching king-top vertical holes. Apparatus constructed from waterproof, virtually indestructible plastic lumber that comes in any color and won't splinter or chip like traditional wood kubb sets.

1 Claim, 3 Drawing Sheets

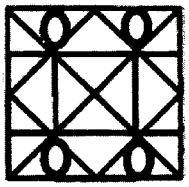
FIG. 8
FIG. 9
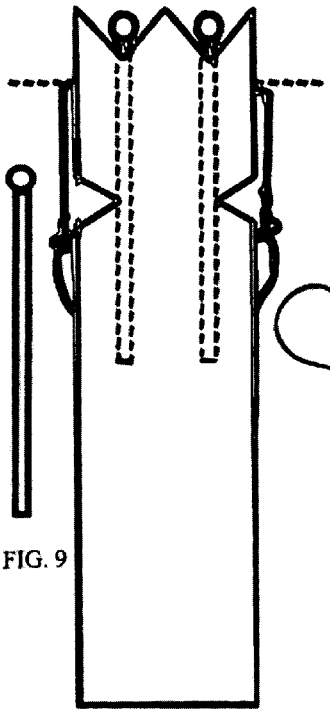
FIG. 10
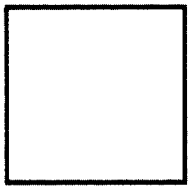
FIG. 11
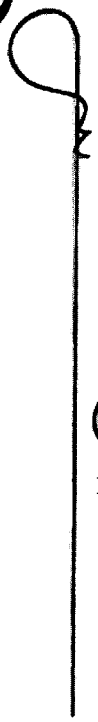
FIG. 12
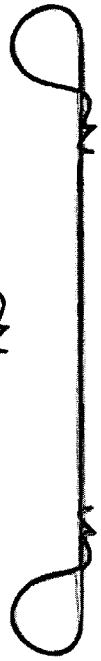
FIG. 13
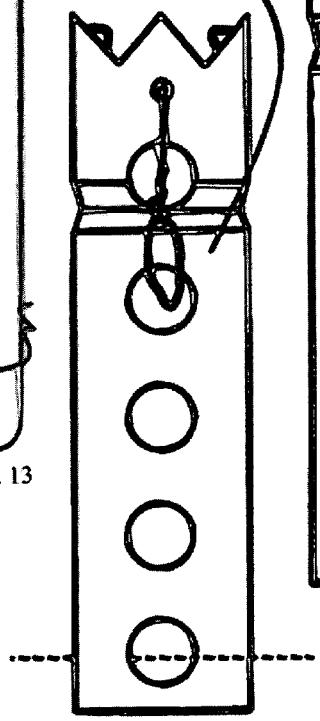
FIG. 14
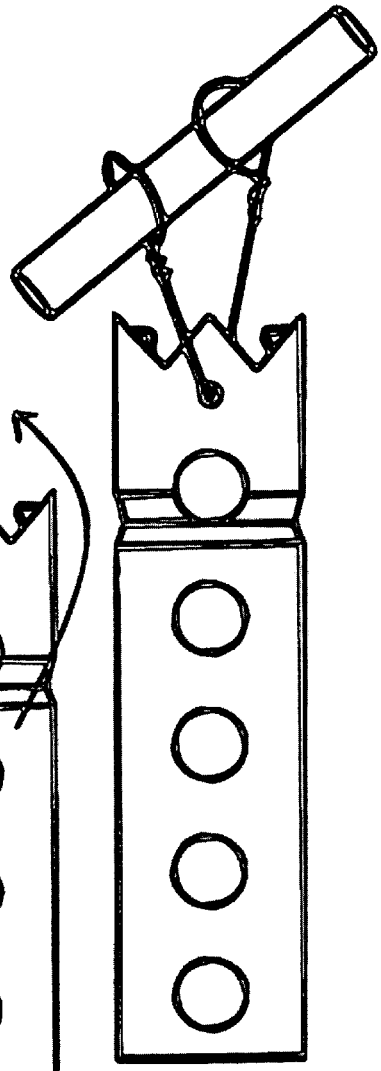
FIG. 15

PLASTIC KUBB (COOB) GAME & CARRYING CASE

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING A TABLE OR A COMPUTER PROGRAM LISTING COMPACT DISC APPENDIX

"Not Applicable"

BACKGROUND OF THE INVENTION

Official kubb world championship rules can be found at: www.vmkubb.com/rules/english.pdf Other traditional kubb game history, descriptions, and examples can be found at: www.kubb.co.uk Site with largest selection of kubb games in America can be viewed and purchased at: www.oldtimegames.com This invention is in both the field of sports and the field of toys. For over 1200 years a social and/or competitive game where players pitch wood batons to topple wood blocks called "kubbspel" or "kubb" (for short) has endured in Gotland, a Baltic island near Sweden. Because the sport is so old, to my knowledge the only pertinent documents copyrighted are World Championship Rules established by the Kubb World Championship. That document also reveals official metric dimensions of each playing piece. My company, SHORT PRODUCTIONS, has trademarked the names 'Ameri-Coob' and 'Coob' in relation to my product, a new version of kubbspel made entirely out of sturdy plastic.

Problems with existing sets of kubb include: 1) After moderate use, wood game pieces chip and nick, and provide potential splinters to players. 2) There's no way to carry or store all twenty-one game pieces without the aid of an additional item such as a sack, bag, or box.

BRIEF SUMMARY OF THE INVENTION

The object of this invention is to make the kubb game out of a sturdy, virtually maintenance free material that won't rot or splinter so to arrange and interconnect each of twenty-one game pieces into one self-contained, easy-to-transport carrying and storage case.

The coob carrying case is assembled out of the twenty-one game pieces I cut and drilled out of plastic lumber material I purchased. Five round batons fit through ten partially drilled blocks and one drilled king to form a case. A piece of 14-gauge vinyl-coated solid wire inserted through the king and wrapped around a sixth baton forms the pivoting handle.

When you want to disassemble the carrying case to play coob, push out baton handle from wire loops, pull-off ten blocks from each end of five batons fitted through the king, remove batons from the king and pull out four marker pegs fitted into the top of the king. Set up the game per established rules, and play. To reassemble when finished, drop marker pegs back into the top king holes, slide and center five batons in any of the five matching king holes, fit each block onto the end of each exposed baton half, slide remaining baton through both wire loops and carry self-contained case by handle like a suitcase, ready to store away.

BRIEF DESCRIPTION OF THE SEVERAL VIEWS OF THE DRAWING (First Page of Figure Drawings)

FIG. 1 depicts the flat bottom view of FIG. 2 and measures 1.9"×1.9".

FIG. 2 depicts the side view of a "block" game piece. The invention includes a total of 10 exact replicas of FIG. 2 made out of 1.9"×1.9" plastic lumber and cut to 5.5". Opposite side is an identical mirror image. Each block weighs approximately 0.43 lbs.

FIG. 3 depicts the top view of FIG. 2. Dashed line shows that a 1.125" diameter hole is cut into the center of the 1.9"×1.9" surface.

FIG. 4 depicts an interior view of FIG. 2. Dashed line shows the 1.125" diameter hole in FIG. 3 continues 4" into FIG. 2 then stops. FIG. 4 is a solid 1.9"×1.9"×5.5" block of plastic with a 4" deep hole, 1.125" in diameter, hollowed down.

FIG. 5 depicts a "baton" game piece. The invention includes a total of 6 exact replicas of FIG. 5. Smooth and round, 1.1" in diameter and 11" long. Each baton is solid, made out of plastic lumber and weighs approximately 0.33 lbs.

FIG. 6 depicts the top view of FIG. 5 and measures 1.1" in diameter. Flat and solid. Opposite bottom view is an identical mirror image.

FIG. 7 is a side view depicting what happens when FIG. 5 is inserted all the way into FIG. 4. Four inches of baton pushes down and fits securely into block. Opposite side is an identical mirror image.

(Second Page of Figure Drawings)

FIG. 8 depicts a top view of FIG. 10 or the "king" game piece. FIG. 8 is 2.9"×2.9".

FIG. 9 depicts a "marker peg" game piece. The invention includes a total of 4 exact replicas of FIG. 9. Each FIG. 9 is a six inch long cylinder 0.2" in diameter with a 0.3" sphere molded on top.

FIG. 10 depicts the front view of the king. Invention requires one 2.9"×2.9" king 1' long, weighing 2.25 lbs. The opposite side view is an identical mirror image. Dashed lines show position FIG. 9 marker pegs are hidden inside.

FIG. 11 depicts the flat bottom view of FIG. 10 and measures 2.9"×2.9".

FIG. 12 depicts an 18" length of 14-gauge vinyl coated solid wire with one side looped.

FIG. 13 depicts the wire with both ends bent back and twisted to create a loop at least 1.2" diameter. Wire holds its shape when bent.

FIG. 14 depicts the side view of the king. FIG. 13 has been inserted, bent down and looped. Arrow indicates FIG. 13 can rotate 360 degrees around. Dashed line indicates 1.125" diameter holes go through to opposite side, which is an exact mirror image.

Figure 5:
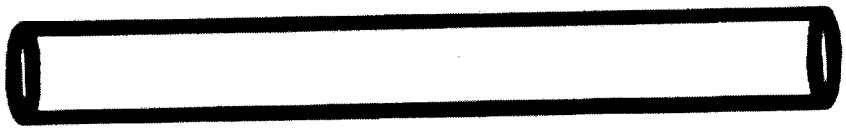
Figure 6:
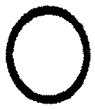

FIG. 15 depicts FIG. 14 when FIG. 13 wire is rotated up and a FIG. 5 baton is inserted forming case handle.

(Third Page of Figure Drawings)

Figure 16:
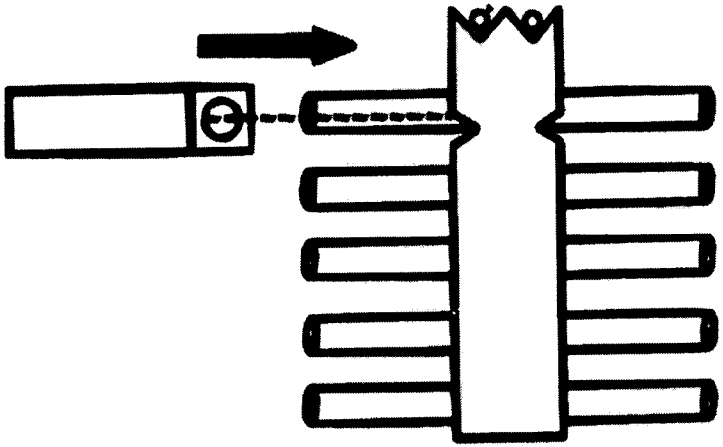

FIG. 16 depicts five FIG. 5 batons, each already inserted and centered through five 1.125" diameter king holes. Next step in building the coob carrying case is to attach one FIG.

Figure 7:
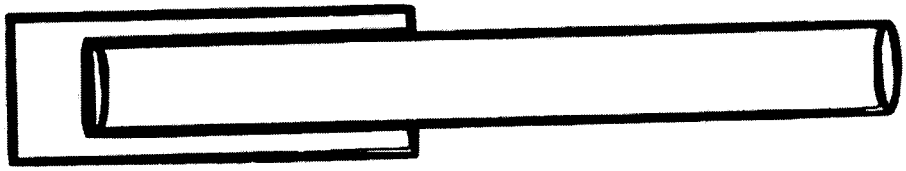

4 block onto the end of each exposed baton side. The arrow and dashed line indicates the fit shown in FIG. 7.

Figure 17:
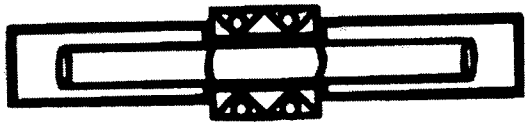
Figure 19:
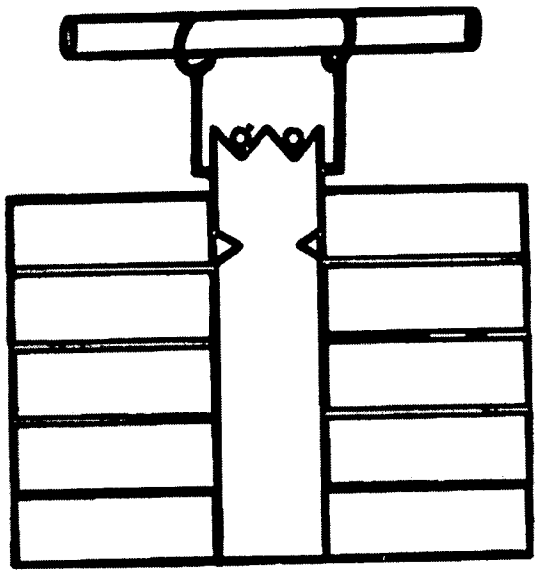

FIG. 17 depicts a top view of FIG. 19. When no one is carrying the coob case, due to gravity the handle and wire pivots down and rests as depicted in FIG. 14.

Figure 18:
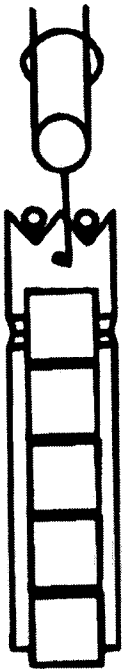

FIG. 18 depicts side view of FIG. 19. Opposite side view is an identical mirror image.

FIG. 19 depicts entire coob carrying case assembled. FIG. 19 is flush and flat on the bottom base and can stand alone. Completed case weighs 8.5 lbs. Opposite side view is an identical mirror image.

DETAILED DESCRIPTION OF THE INVENTION

In July, 2004 I went to Gotland and purchased a set of "kubbspel", a game where you must pitch batons across a 15'×25' playing field to topple wood blocks and then knock over a larger king. The wood pieces chipped and provided my hand with a splinter after only a few weeks of play. I was also upset that I had to cram all twenty-one bulky game pieces into a flimsy mesh satchel. I wanted to make a version of the game out of a long-lasting material while creating a carrying case formulated from every existing game piece. In addition, as much as possible, I wanted to maintain the integrity and tradition of the 1200 year old sport with regards to weights, dimensions, and rules.

My intent is to take this invention and have a steel mold made so a manufacturer can pour plastic into it for reproduction and resale. My prototype was constructed using recycled plastic lumber, a drill press, a miter saw, a band saw, and a belt sander.

To make one coob carrying case I purchased plastic lumber from retail distributors.

I purchased a 12 foot dowel 1.1" in diameter and cut six 11" pieces using a miter saw (see FIG. 5).

Figure 1:
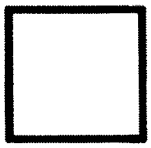
Figure 2:
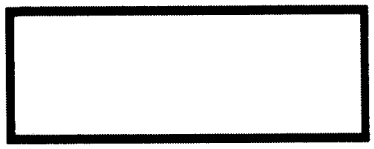
Figure 3:
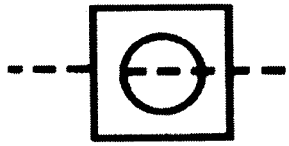
Figure 4:
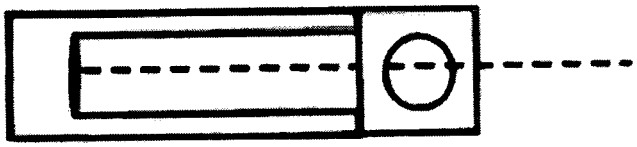

I purchased a 12 foot plank 1.9"×1.9" and cut ten 5.5" pieces using a miter saw. (see FIG. 2) Next I took each block and using a 1⅛" drill bit, on a drill press, drilled down the block's center four inches deep and 1.125" in diameter (FIG. 3 and FIG. 4).

I purchased an 8-foot plank 2.9"×2.9" and cut a one-foot king using a miter saw (see FIG. 10).

To make FIG. 14, I took the solid block of cut plastic and measured 0.95" from the bottom. I drilled a 1.125" diameter hole all the way through to the other side. I measured 0.95" from the top of the drilled hole to mark the bottom of what will be the next drilled hole. I continued until all five holes were drilled 1.9" apart center to center. I rotated FIG. 14 ninety degrees to the side for the following step.

To create FIG. 10, I measured 2.7 inches from king top and using a band saw, cut 0.5" down at a 45 degree angle. I then measured 3.8" from king top and cut 0.5" up at a 45 degree angle. I removed 2.9" triangle cutout and did the same on the opposite side.

To create the king top as shown in FIG. 8, I took FIG. 10 and from the left corner sawed down 1" (entire 2.9" width) at a 45 degree angle towards the king top center. From the right corner, I sawed down 1" at a 45 degree angle towards the king top center. From the FIG. 10 top center, I sawed down 1" (again entire 2.9" width) at a 45 degree angle towards the left side then sawed down 1" at a 45 degree angle towards the right. I blew out plastic shavings and removed cutout material. I then turned FIG. 10 to FIG. 14 side and repeated the procedure with the same four 45 degree angle 1" cuts. This makes a tic-tac-toe board on the surface with triangles rising next-to and between the grid. When looking down, (FIG. 8) a 1.3"×1.3" pyramid rises from the king top true center. There are nine equally spaced triangle points at the top of the grid once everything cut by band-saw is removed.

I moved the king top against a belt-sander to dull the nine sharp triangular points.

I drilled four 5.5" deep holes in the top of the king so that FIG. 9 marker pins could be inserted. Per FIG. 8, center of holes are 0.7" in from the right side and 0.7" in from the left side. Each hole is 0.25" in diameter. FIG. 9 are 0.2" diameter plastic poles with a 0.3" sphere ball molded atop. The ball-top falls 0.2" shy from any point of the king top. The ball-top makes it easy to slide marker pegs in and out of slots.

Regarding FIG. 14, I measured 1.1" from king top center and drilled a 0.25" diameter hole 2.9" horizontally through the king. I took an 18" piece of 14-gauge vinyl coated solid wire, folded one end into a loop and twisted it tightly to make a seal. I then threaded the straight wire end through the horizontal hole, centering it. I bent both ends at the hole, then twisted and tied the straight end into a loop. Gravity has wire down in FIG. 14 but one could spin it all the way around. I flipped the wire up and inserted a FIG. 5 baton through the two loops to create a handle similar to a suitcase. (See FIG. 15). Horizontal hole does not intersect with any of the vertical holes shown in FIG. 8 and goes entirely through FIG. 14.

Next I inserted remaining five, FIG. 5 batons through each of five matching 1.125" king holes (FIG. 15 shows side view before baton insertion). I centered and positioned each baton so four inches hang off each end of the king (FIG. 16). I took the ten blocks (FIG. 4) and slid the open-end (FIG. 3) onto each baton end.

FIG. 16 reveals where and how batons are placed through king and inside blocks.

FIG. 19 represents the completed invention. Five batons are securely hidden through king and inside drilled blocks. Marker pegs are in their holes. The wire handle is attached and the final baton is ready to serve as a handle. Even with baton, the wire frame and handle easily flips up or down to rest on either side of FIG. 10.

With every block fastened to each baton end, via your handle, you can transport the coob game to your destination or simply store it away. The advantages of making kubb (coob) in plastic as opposed to wood is that the game pieces upon constant inevitable impact, along with the case, will remain rugged, never rotting or splintering. Plastic is also waterproof, never needing to be sanded or painted.

{While I have illustrated and described my invention by means of specific embodiments, it is to be understood that numerous changes and modifications may be made without departing from its spirit and scope.}

What I claim as my invention:

1. A unique portable apparatus and carrying arrangement consisting of:

Six identical cylindrical dowels, each having a predetermined diameter and length;

ten identical elongated plastic-lumber blocks, each having square cross section and a partial hole drilled in one end of the block along the length of the block, wherein the hole diameter being larger than the diameter of the dowel to accommodate partial insertion of the dowel into each hole;

a cord for making a handle for carrying the apparatus;

four identical marker pegs, each having an elongated cylindrical portion with a predetermined diameter and a spherical portion at one end;

a larger elongated plastic-lumber block of square cross section and having a top end carved representing a king-crown, wherein five cylindrical holes larger than the diameter of dowels are drilled horizontally and transverse through the elongated block across two opposite sides of the block, four smaller cylindrical holes larger than the diameter of the marker pegs partially drilled from the top end vertically down into the block to accommodate marker pegs and a smaller hole drilled through the crown portion and transverse to the elongated portion of the block for accommodating the apparatus carrying cord;

placing the larger block on the ground in the upstanding position with the crown portion at the top;

placing five dowels across five holes in the block to extend the ends of dowels outside the block;

placing ten smaller blocks, one on each end of the dowel by inserting the dowels into the holes of the smaller blocks;

placing four marker pins into the four holes on the top end of the block;

passing the cord through the cord hole, making loops at each end of the cord, inserting a sixth dowel through both loops and carrying the apparatus.

* * * * *